US011299857B2

(12) United States Patent
Pietikäinen et al.

(10) Patent No.: US 11,299,857 B2
(45) Date of Patent: Apr. 12, 2022

(54) METHOD FOR SIZING A MULTI-PLY FIBER WEB AND A FORMING SECTION FOR A MULTI-PLY FIBER WEB

(71) Applicant: Valmet Technologies, Inc., Espoo (FI)

(72) Inventors: Reijo Pietikäinen, Järvenpää (FI); Antti Poikolainen, Jyväskylä (FI); Juan Cecchini, Jyväskylä (FI); Teuvo Virkkunen, Jyväskylä (FI)

(73) Assignee: Valmet Technologies, Inc., Espoo (FI)

( * ) Notice: Subject to any disclaimer, the term of this patent is extended or adjusted under 35 U.S.C. 154(b) by 228 days.

(21) Appl. No.: 16/601,171

(22) Filed: Oct. 14, 2019

(65) Prior Publication Data

US 2020/0115854 A1 Apr. 16, 2020

(30) Foreign Application Priority Data

Oct. 15, 2018 (FI) ..... 20185867

(51) Int. Cl.
*D21H 27/34* (2006.01)
*D21F 9/00* (2006.01)
(Continued)

(52) U.S. Cl.
CPC ..... *D21H 27/34* (2013.01); *D21F 9/006* (2013.01); *D21H 21/16* (2013.01); *D21H 23/48* (2013.01)

(58) Field of Classification Search
CPC ..... D21H 27/34; D21H 21/16; D21H 23/48; D21H 21/28; D21H 23/30; D21H 27/30;
(Continued)

(56) References Cited

U.S. PATENT DOCUMENTS 2,026,594 A * 1/1936 Richter ..... D06N 7/0005 162/124
2,286,924 A * 6/1942 Gunnar ..... D21F 11/04 162/124
(Continued)

FOREIGN PATENT DOCUMENTS

AT 506423 B1 * 4/2015 ..... B05C 5/008
EP 1239078 A1 * 9/2002 ..... D21H 23/48
(Continued)

OTHER PUBLICATIONS

Finnish Search Report for FI20185867 dated May 15, 2019.
Extended European Search Report for EP19199235 dated Dec. 16, 2019.

*Primary Examiner* — Jose A Fortuna
(74) *Attorney, Agent, or Firm* — Stiennon & Stiennon

(57) ABSTRACT

A method for forming a multi-ply fiber web in which least part of the sizing of the multi-ply fiber web is provided by applying sizing agent in the form of foam by a curtain type application device (C10, C20) in between at least two layers of the multi-ply fiber web in the forming section. The invention also relates to a forming section for a multi-ply fiber web having at least one twin-wire forming part formed between a wire (10) for the bottom layer and a wire (20) for the top layer of the multi-ply fiber web, where the layers are joined, and the treated layers combined. The forming section has a curtain type application device (C10, C20) for applying sizing agent in the form of foam in between two layers of the multi-ply fiber web in the forming section of a multi-ply fiber web production line.

8 Claims, 2 Drawing Sheets

(51) Int. Cl.
*D21H 21/16* (2006.01)
*D21H 23/48* (2006.01)

(58) Field of Classification Search
CPC ..... D21H 21/56; D21H 19/34; D21H 19/14; D21H 27/32; D21H 17/60; D21H 17/28; D21F 9/006; D21F 11/002; D21F 11/04; D21F 11/14; B32B 29/00
See application file for complete search history.

(56) References Cited

U.S. PATENT DOCUMENTS 4,093,016 A * 6/1978 Coleman ..... D21H 5/0045 162/124
4,597,831 A * 7/1986 Anderson ..... D21H 17/62 162/135
4,816,320 A * 3/1989 St. Cyr ..... A47K 10/16 428/198
4,885,202 A * 12/1989 Lloyd ..... B32B 5/26 428/171
5,089,296 A * 2/1992 Bafford ..... D06M 23/04 427/208
5,591,489 A * 1/1997 Dragner ..... C08F 212/04 347/105
5,792,317 A * 8/1998 Taylor ..... D21H 23/28 162/175
5,985,030 A * 11/1999 Taylor ..... D21H 23/28 118/325
6,027,611 A * 2/2000 McFarland ..... B32B 29/00 162/127
6,332,952 B1 * 12/2001 Hsu ..... B32B 23/10 162/127
6,896,766 B2 * 5/2005 Sarbo ..... A61K 8/0208 162/112
7,381,299 B2 * 6/2008 Shannon ..... D21H 27/30 162/109
7,892,613 B2 2/2011 Meazle et al.
8,025,764 B2 * 9/2011 Bhat ..... B32B 29/005 162/117
8,216,424 B2 * 7/2012 Bhat ..... B32B 29/06 162/125
10,676,868 B2 * 6/2020 Heiskanen ..... C08J 5/18
11,001,969 B2 * 5/2021 Backfolk ..... D21H 21/36
2002/0117277 A1 * 8/2002 Johnson ..... B32B 29/005 162/124
2002/0162243 A1 * 11/2002 Runge ..... D21C 9/002 34/444
2004/0045687 A1 * 3/2004 Shannon ..... D21H 23/28 162/158
2004/0118531 A1 * 6/2004 Shannon ..... D21H 23/76 162/109
2004/0118532 A1 * 6/2004 Sarbo ..... A61Q 19/10 162/109
2004/0121080 A1 6/2004 Ursheler et al.
2004/0244927 A1 * 12/2004 Pianta ..... D21H 23/24 162/124
2007/0202283 A1 * 8/2007 Meazle ..... D21H 27/30 428/34.2
2008/0044644 A1 * 2/2008 Luu ..... B32B 29/06 428/311.71
2008/0115898 A1 * 5/2008 Gelli ..... B32B 29/005 162/109
2010/0239843 A1 * 9/2010 Luu ..... B32B 29/06 428/311.71
2010/0243187 A1 * 9/2010 Runge ..... D21C 9/002 162/164.4
2015/0096700 A1 * 4/2015 Heiskanen ..... D21H 11/02 162/174
2015/0211189 A1 * 7/2015 Anderson ..... D21H 11/00 162/124
2016/0002860 A1 * 1/2016 Luu ..... D21H 17/55 162/158
2017/0335522 A1 * 11/2017 Heiskanen ..... D21H 11/02
2019/0226144 A1 * 7/2019 Backfolk ..... D21H 21/56
2020/0115854 A1 * 4/2020 Pietikainen ..... D21H 21/56
2020/0407916 A1 * 12/2020 Cecchini ..... D21F 1/08

FOREIGN PATENT DOCUMENTS

EP 1239078 A1 9/2002
EP 3382094 A1 * 10/2018 ..... D21F 9/006
EP 3382094 A1 10/2018
FI 124556 A 10/2013
WO 03102301 A1 12/2003
WO WO-03102301 A * 12/2003 ..... D21H 21/56
WO 2006090008 A1 8/2006
WO WO-2006090008 A1 * 8/2006 ..... B05D 1/305
WO WO-2013160564 A1 * 10/2013 ..... D21H 17/22
WO 2018011667 A1 1/2018
WO WO-2018011667 A1 * 1/2018 ..... D21H 21/36

* cited by examiner

METHOD FOR SIZING A MULTI-PLY FIBER WEB AND A FORMING SECTION FOR A MULTI-PLY FIBER WEB

CROSS REFERENCES TO RELATED APPLICATIONS

This application claims priority on FI 20185867 filed on Oct. 15, 2018, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates generally to producing multi-ply fiber webs. Particularly the invention relates to a method for sizing a multi-ply fiber web in which at least part of the forming is done in a twin-wire forming part formed between a wire for the bottom layer of the multi-ply fiber web and a wire for the top layer of the multi-ply fiber web, in which the layers for the multi-ply fiber web are joined and treated layers combined in the twin-wire part, in which at least part of the sizing of the multi-ply fiber web is provided by applying sizing agent by a curtain type application device and to a forming section for a multi-ply fiber web. The invention also is relates to a forming section for a multi-ply fiber web having at least one twin-wire forming part formed between a wire for the bottom layer of the multi-ply fiber web and a wire for the top layer of the multi-ply fiber web, in which twin-wire part, the layers for the multi-ply fiber web are joined and treated layers combined, which forming section comprises at least a curtain type application device for applying sizing agent.

As known from the prior art in fiber web machines, especially in paper and board machines, the fiber web is produced and treated in an assembly formed by a number of apparatuses arranged consecutively in a process line. A typical production and treatment line comprises a forming section comprising a headbox and a forming unit and a press section as well as a subsequent drying section and a reel-up. The production and treatment line can further comprise other devices and sections for finishing the fiber web, for example, a size press, a calender, a coating section. The production and treatment line also comprises typically at least one winder for forming customer rolls as well as a roll packaging apparatus. In this description and the following claims by fiber webs are meant especially containerboard or cartonboard webs.

The task of a forming unit is to remove water from a fiber suspension fed by the headbox. When the web is manufactured of watery fiber stock, water in the stock is removed on the forming section through a forming wire or forming wires for starting the formation of the web. Fibers remain on the forming wire or between the two forming wires moving together. Depending on the grade of the web being manufactured, different types of stocks are used. The volume for which water can be removed from different stocks for achieving a web of good quality is a function of many factors, such as e.g. a function of the desired basis weight of the web, the design speed of the machine, and the desired level of fines, fibers and fill materials in the finished product. Many types of devices are known on the forming unit such as foil strips, suction boxes, turning rolls, suction rolls, and rolls provided with an open surface, which are used in many different arrangements and arrays when trying to optimize the volume, time and location of water being removed when forming the web. The manufacturing of a high-quality end-product of desired grade is a function of the volume of dewatering, the dewatering method, the duration of dewatering, and the location of dewatering.

A commonly used method of making a multi-ply fiber web is based on the use of several separate web forming units in which the different layers of the fiber web are caused to be drained in a layer by layer fashion either onto one another or onto separate wires, in which case they are combined with one another after partial dewatering. Typically in multi-ply/multilayer fiber web production, i.e. when producing a fiber web having more than one layer, the term "multi-ply" is used when the layers are formed separately in the forming section and the term "multilayer" is used when a multilayer headbox is used for feeding suspension layers to the forming section even though these terms multi-ply/multilayer are used very often synonymously and thus the difference can be defined by the context only.

A foam application system comprises typically a mixing device, a pumping device, a foaming device, a piping system and an application unit. The foaming is based on powerful mixing for adding air into the liquid-based substance with a surfactant additive, resulting in a substantial increase in the specific volume and thus making the handling and application of the substance much easier at small dry substance weights. The foam application device typically comprises an application head with a slot-type nozzle for extruding the foam onto the web. Very shortly after the application, the foamy structure disintegrates, absorbs and spreads into the surface structure of the web, leaving a wetted substance layer.

In production of fiber webs, for example in production of paper or board webs, sizing is used to alter the properties of a fiber web by adding sizing agents, for example starch or other sizing agents. Sizing can be divided into internal sizing and surface sizing. In internal sizing, sometimes called stock sizing, the sizing agent is added to pulp in the wet end of the fiber web machine before forming. In surface sizing the sizing agent is added onto the surface of the fiber web typically at the dry end of the fiber web machine. Sizing is used in order to improve paper web properties, in particular water resistance, water absorption properties, strength, internal strength and bending stiffness. In addition, runnability as well as dusting tendency can be affected favorably. Sizing of a fiber web can also be cationic pulp sizing but as a disadvantages of this known method is low sizing response when large amounts of sizing agent is used, complicated chemistry of the short circulation system, poor retention and in large sizing agent dosages degradation of the formation. In pulp sizing by multilayer headbox of a forming section for middle layer additives are used for fixation of the sizing agent and thus the compound achieved is firmer containing larger particles and fixation to the fiber web is increased. It is also known to apply spray sizing agent, for example so called spray starch, typically granular (uncooked) starch slurry, in between the layers of a multi-ply fiber web. Disadvantages of this known method are low sizing response and misting. It is also known to apply sizing agent onto the surface of a one-layer fiber web by spray or foam application. Disadvantageous in this method is that the sizing agent remains on the surface of the fiber web and thus may easily be flushed away and also that sizing agent distribution in the thickness direction of the fiber web is inclined as on the applied surface remains more sizing agent than reaches the other side and thus only minor strengthening is achieved, particularly with thick paper or board grades.

In FI patent publication 124556 is disclosed a method for the preparation of a hydrophobically sized layer of a fibrous web, comprising the steps of bringing water, microfibrillated cellulose (MFC), hydrophobic size, and a heat-sensitive surfactant into a foam, supplying the foam onto a forming fabric, dewatering the foam on the forming fabric by suction to form a web, subjecting the web to drying, and heating the web to suppress the hydrophilic functionality of the surfactant.

In U.S. Pat. No. 7,892,613 is disclosed a method of making a multi-ply paper or paperboard while reducing weight basis of a top ply, the method comprising the steps of applying a mixture comprising starch and a filler to a surface of a base ply to form an intermediate layer, the base ply includes a preselected color, and applying the top ply to a surface of the intermediate layer wherein the intermediate layer is configured to obscure the color of the base ply when viewed through the top ply. In connection with this known method a sizer comprising a special applicator that is positioned over the Fourdrinier machine is used and a liquid dispersion of additive is forced out of a narrow slot in the applicator and falls as a full-width curtain onto the wet stock.

SUMMARY OF THE INVENTION

An object of the invention is to create a method for sizing a multi-ply fiber web and a forming section for a multi-ply fiber web, in which the disadvantages and problems of prior art are eliminated or at least minimized.

A particular object of the invention is to provide cost-effectively a method for sizing a multi-ply fiber web and a forming section for a multi-ply fiber web, by which the problems relating to sizing agent distribution, outcome of sizing, especially relating to strength property results, retention of fiber webs, runnability and/or chemistry of the short circulation of the fiber web are solved.

In order to achieve the abovementioned objects, the method for sizing a multi-ply fiber web according to the invention is mainly characterized in that the forming section comprises at least the curtain type application device for applying sizing agent in the form of foam in between at least two layers of the multi-ply fiber web in a forming section of a multi-ply fiber web production line. And a forming section for a multi-ply fiber web according to the invention is mainly characterized in that the forming section has at least a curtain type application device for applying sizing agent in the form of foam between at least two layers of the multi-ply fiber web in a forming section of a multi-ply fiber web production line.

According to the invention in the method for sizing a multi-ply fiber web at least part of the forming is done in a twin-wire forming part formed between a wire for the bottom layer of the multi-ply fiber web and a wire for the top layer of the multi-ply fiber web, in which the layers for the multi-ply fiber web are joined and treated layers combined in the twin-wire part, whereby at least part of the sizing of the multi-ply fiber web is provided by applying sizing agent in the form of foam by a curtain type application device in between at least two layers of the multi-ply fiber web in the forming section of a multi-ply fiber web production line.

According to an advantageous feature of the invention the sizing agent in the form of foam is applied by a non-contacting application method and means.

According to an advantageous feature of the invention the sizing agent in the form of foam is applied by a slot-type curtain application device.

According to an advantageous feature of the invention suction and/or under-pressure is created at the location of the curtain type application device by a suction or an under-pressure device on the opposite side of the multi-ply fiber web layer and its support wire in relation to the curtain application device. Thus, absorption of the sizing agent into the fiber web layer is improved as well as application of the sizing agent foam is stabilized.

According to an advantageous feature of the invention conveyance and penetration of the sizing agent into the web layer and/or over a boundary between the joined web layers is guided by suction means and/or by a sleeve roll after the application of the sizing agent in the form of foam by the curtain application device before and/or after the web layers are joined by the combining roll at the beginning of the twin-wire forming part.

Advantageously the suction device is located on the opposite side of the multi-ply fiber web layer in relation to the curtain application device just before the application location of the sizing agent in the form of foam, whereby the suction effect eliminates or at least minimizes the disadvantages of the boundary air flow on the side of the multi-ply fiber web layer, where the application is provided.

According to an advantageous feature of the invention boundary air flow is turned off the running direction of the multi-ply fiber web before curtain application of the sizing agent in the form of foam by an air guide.

According to the invention the forming section for a multi-ply fiber web comprises at least one twin-wire forming part formed between a wire for the bottom layer of the multi-ply fiber web and a wire for the top layer of the multi-ply fiber web, in which twin-wire part in the layers for the multi-ply fiber web are joined and treated layers combined, wherein the forming section comprises at least one curtain type application device for applying sizing agent in the form of foam in between at least two layers of the multi-ply fiber web in a forming section of a multi-ply fiber web production line.

According to an advantageous feature of the invention the curtain type application device does not contact any part of the fiber web.

According to an advantageous feature of the invention the curtain type application device is a slot-type application device.

According to an advantageous feature of the invention the forming section of the multi-ply fiber web production line comprises a suction or an under-pressure device on the opposite side of the multi-ply fiber web and its support wire in relation to the curtain application device. Thus, absorption of the sizing agent into the fiber web layer is improved as well as application of the sizing agent foam is stabilized.

According to an advantageous feature of the invention the forming section of the multi-ply fiber web production line comprises suction means and/or a sleeve roll to guide conveyance and penetration of the sizing agent into the web layer and/or over a boundary between the joined web layers after the application of the sizing agent in the form of foam by the curtain application device before and/or after the web layers are joined by the combining roll at the beginning of the twin-wire forming part.

Advantageously the suction device is located just before the application location of the sizing agent in the form of foam, whereby the suction effect eliminates or at least minimizes the disadvantages of the boundary air flow.

According to an advantageous feature of the invention the forming section of the multi-ply fiber web production line comprises an air guide, preferably an air curtain and/or a reversing blade before the curtain type application device for turning boundary air flow off the running direction of the multi-ply fiber web before curtain application of the sizing agent.

According to an advantageous feature of the invention a steam-box is provided just after the air guide.

According to an advantageous feature of the invention the foam of the sizing agent comprises at least 50%-vol. gas, preferably air.

According to an advantageous feature of the invention the sizing agent is applied at least in between layers that are middle layers of the multi-ply fiber web.

According to an advantageous feature of the invention the sizing agent is applied at least in between the top layer and the layer next to it.

According to an advantageous feature of the invention the sizing agent applied in the form of foam penetrates deep into the structure of the multi-ply fiber web and advantageously the conveyance and the penetration of the sizing agent in the form of foam is guided to a desired direction and depth by a water-removal means and by controlling the amount and viscosity of the foam, by conveying the sizing agent to both layers on each side of the boundary of the web layers to be joined the sizing in the boundary zone between the layers joined is efficient.

According to an advantageous feature of the invention the multi-ply fiber web is cartonboard, for example folding box board (FBB), white lined chipboard (WLC), solid bleached board (SBS) or liquid packaging board (LPB). In addition, the multi-ply board is advantageously containerboard, for example krafliner (KL), testliner (TL) or white top liner (WTL).

The multi-ply fiber web can be a coated or an uncoated fiber web.

By the forming section according to the invention many advantages are achieved: The bulkiness of the fiber web is increased, when the sizing agent is applied in between the layers of the multi-ply fiber web in the form of foam. Also, the strength properties, especially ply-bond strength, of the fiber web are improved due to the uniform sizing agent distribution achieved by applying the sizing agent in between the layers of the multi-ply fiber web in the form of foam. In addition, internal strength is improved due to application to the inner structure (i.e. between the plies) and due to good movability and/or penetration of the sizing agent within the fiber web layer in the thickness direction. Thus, grammage of the fiber web can be decreased as the critical strength properties are achieved by better effect of the sizing agents. Further, good retention is achieved due to beneficial application to the inner structure and cost savings are achieved as smaller amounts of sizing agent are needed as it is applied by foam and thus the sizing agent remains within the fiber web and does not flush away with the following water removal steps. Surprisingly, sizing agent in the form of foam penetrates inside the fiber web porous structure much better than state of the art solutions. Additionally, good runnability properties of the fiber web are achieved as misting and other spreading as well as adherence to rolls and other components of the sizing agent is minimized due to foam application of the sizing agent causing good distribution and stability of the sizing agent. Also, the chemistry of the short circulation is easier as handling of the sizing agent can be isolated from the pulp circulation. Foamed sizing agent can contain starch, microfibrillated cellulose MFC, nanofibrillated cellulose NFC or a mixture of these.

The curtain type application device can be any kind of applicator which creates a curtain-like sizing film, for example a slot-type or a slide-type curtain application device. The slot-type curtain application device is advantageous because dwell time is shortest from the nozzle to the fiber web.

In the following the invention is explained in detail with reference to the accompanying drawing to which the invention is not to be narrowly limited.

DESCRIPTION OF THE PREFERRED EMBODIMENTS

During the course of the following description like numbers and signs will be used to identify like elements according to the different views which illustrate the invention and its advantageous examples. In the figures some repetitive reference signs have been omitted for clarity reasons.

Figure 1:
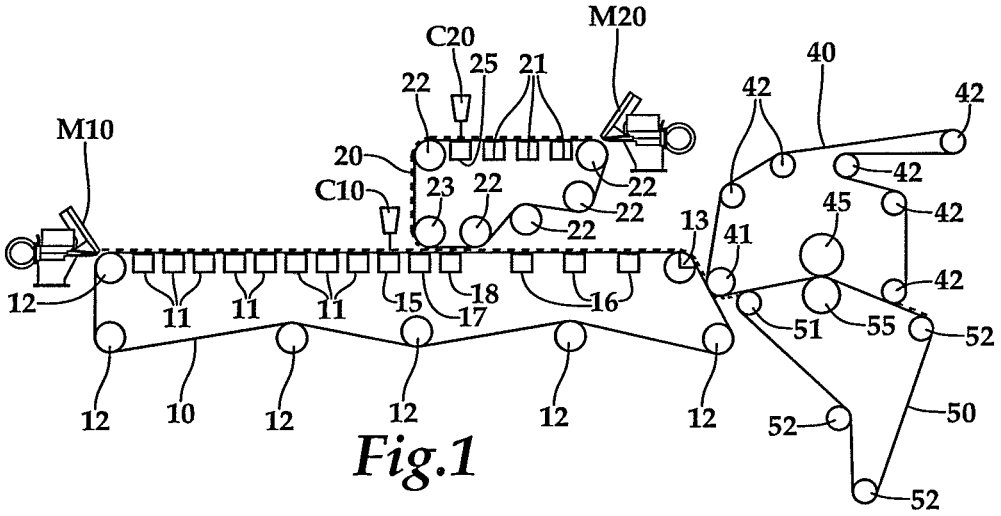
In FIG. 1 is shown schematically an advantageous example of a forming section according to the invention.

In FIG. 1 is shown an example of a forming section for a multi-ply fiber web, in this example for a two-layer fiber web. The forming section comprises two headboxs M10, M20 one for each layer, from which a stock suspension is fed to the forming unit for each layer beginning as one wire part comprising a wire 10 for the bottom layer of the multi-ply fiber web and a wire 20 for the top layer of the multi-ply fiber web. Each wire has rolls 12, 22 for guiding, tensioning and/or driving the wire 10, 20 as an endless loop. The stock suspension from the headboxs M10, M20 are first fed onto the wires 10, 20 and thereafter the stock on the wires is guided past water removal means 11, 21, 15, and 25 located inside loops formed by the wires. Inside of the loops of wires 10, 20 at least one suction means 15, 25 is located. During the run of the stock on the wires part the water removal is substantially horizontal. Curtain application devices C10, C20 are located along the run of the stock layers on the wires for applying sizing agent, in the form of foam, by a curtain type application device onto the stock layer thus between the layers of the multi-ply fiber web in the forming section. The curtain application device C10, C20 is advantageously located such that the suction means 15, 25 are located on the opposite side of the multi-ply fiber web inside of the loop of the wires 10, 20. In that way the sizing agent contacts the stock layer on the suction means 15, 25 area.

Advantageously, only one application device C10, C20 for the foam is used, which device C10 most advantageously applies the foam onto the fiber web layer on the lower wire 10. The application device C20 for the foam can also be only applicating onto the fiber web on the upper wire 20. It is also possible to use two application devices C10, C20 as shown in the example of FIG. 1. Also, more than one application device C10, C20 can be used consecutively for one of the fiber web layers.

The stock forming the top layer of the multi-ply fiber web on the wire 20 is after the top layer is formed guided downwards towards the first wire 10 and the runs of the wire 10 for the bottom layer and the wire 20 for the top layer are united by a combining roll 23 to form a twin-wire part of the forming section and the webs for the bottom layer and the top layer are guided into a gap formed between the wires 10, 20 forming the twin-wire part of the forming unit. Thus the web layers are joined together by a combining roll 23 at the beginning of the twin-wire forming part. The combining roll 23 is situated within the top layer wire loop 20. Thus, the sizing agent applied in the form of foam by the curtain application devices C10, C20 onto each layer of the web is guided in between the layers. Advantageously, after applying the sizing agent in the form of foam by the curtain application device C10 the sizing agent's conveyance and penetration into the web layer is assisted such that the sizing agent extends deeper into the web layer on which the sizing agent is applied in the form of foam by guiding the foam in the desired direction. In the example of FIG. 1 a suction device(s) 17 are provided inside the lower wire loop 10 and after the application of the sizing agent in the form of foam by the curtain application device C10 but before the web layers are joined by the combining roll 23 at the beginning of the twin-wire forming part in order to assist the conveyance and penetration of the sizing agent into the web layer.

Additionally advantageously, after applying the sizing agent in the form of foam by the curtain application device C20 and after the web layers have been joined by the combining roll 23 conveyance of the sizing agent is further enhanced by guiding the direction of conveyance of the sizing agent over the joining boundary towards the web layer on the wire 10 on the other side of the boundary of the joining web layers. In the example of FIG. 1 suction means 18 are provided inside the lower wire loop 10 and after the application of the sizing agent in the form of foam by the curtain application device C20 and after the web layers have been joined by the combining roll 23 at the beginning of the twin-wire forming part in order to enhance the conveyance of the sizing agent over the boundary between the joined web layers.

Additionally advantageously, after applying the sizing agent in the form of foam by the curtain application device C20, it would be possible to replace the traditional combining roll 23 by a sleeve roll (not shown). In that embodiment the sleeve roll is provided inside the upper wire loop 20 after the application of the sizing agent in the form of foam by the curtain application device C20 and after the web layers have been joined by the sleeve roll at the beginning of the twin-wire forming part in order to enhance the conveyance of the sizing agent over the boundary between the web layers joined and deeper towards the bottom surface of the multi-ply fiber web. A sleeve roll is a roll that comprises a stationary support shaft, a belt loop, which is led to circle around the stationary support shaft, wherein the sleeve roll further comprises at least one curvilinear dewatering zone consisting of two partial curves such that the radius of curvature of a first partial curve is greater than the radius of curvature of a second partial curve following the first partial curve in the travel direction of the belt loop. A sleeve roll configuration is disclosed for example in EP patent application 2017164069 published as EP3382094. After the joining of the layers the multi-ply fiber web is guided on the wire 10 supporting the bottom side of the multi-ply fiber web. Support foils 16 located inside the wire 10 loop engage the wire beneath the multi-ply fiber web. The support foils 16 do not deviate the run of the wire 10 but only remove water from the bottom surface of the wire 10 and support the run of the wire 10 as the multi-ply fiber web is guided via the suction roll 13 towards a pick-up roll 41 for transferring the multi-ply fiber web to a first press fabric 40 of a press section. The press section also comprises a second press fabric 50 with a roll 51. The press fabrics 40, 50 comprise rolls 42, 52 for guiding, tensioning and/or driving the fabrics 40, 50 in an endless loop. In the press section the multi-ply fiber web is guided between the first press fabric 40 and the second press fabric 50 to a press nip formed between a first press roll 45 and a second press roll 55. After the press section the fiber web is guided to a drying section (not shown).

Figure 2:
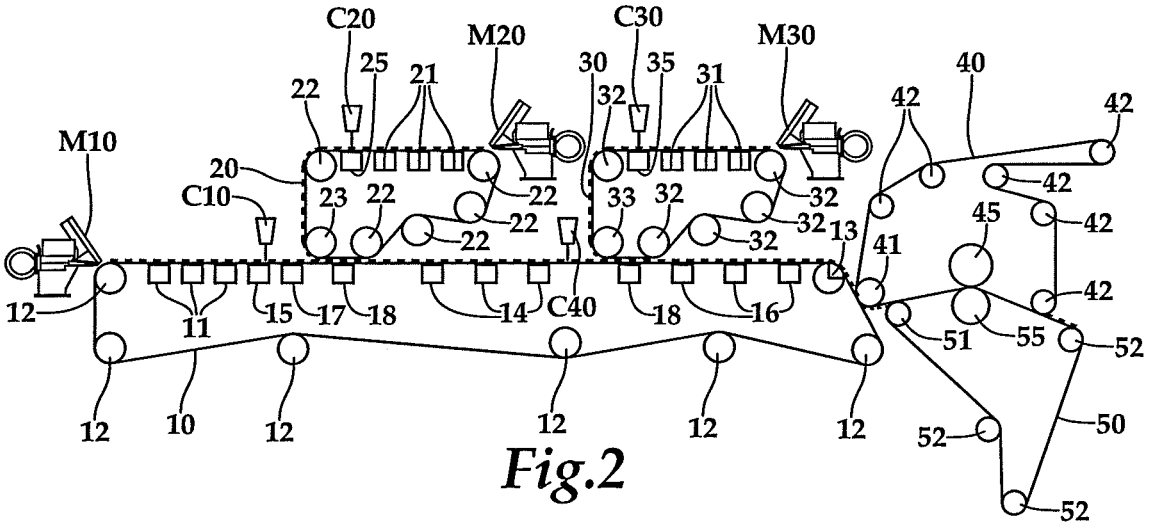
In FIG. 2 is shown schematically another advantageous example of a forming section according to the invention.

In FIG. 2 is shown an example of a forming section for a multi-ply fiber web, in this example a three-layer fiber web is formed. The forming section comprises headboxes M10, M20, M30 one for each layer, from the headboxes the stock suspension is fed to the forming unit for each layer beginning with one wire part comprising a wire 10 for the bottom layer of the multi-ply fiber web and a wire 20 for the middle layer of the multi-ply fiber web and a wire 30 the top layer of the multi-ply fiber web, each wire comprising rolls 12, 22, 32 for guiding and driving the wire 10, 20, 30 as an endless loop. The stock suspension is first fed onto the wires 10, 20, 30 and thereafter water is removed via removal means 11, 15, 21, 25, 31, 35, which can be for example forming shoes and/or suction devices, each loop comprising at least one suction device 15, 25, 35. The run of the wire 10, 20, 30 during this water removal on each of the wires a part of the wires is substantially horizontal. A curtain application device C10, C20, C30, C40 is located over the stock layers where the wires are substantially horizontal for applying sizing agent in the form of foam by a curtain type application device onto the stock layer such that sizing agent is applied to each stock layer before said layers are joined so that the sizing agent is between at the layers of the multi-ply fiber web in the forming section. The curtain application device C10, C20, C30, C40 is advantageously located such that the suction means 15, 25, 35 are located on the opposite side of the multi-ply fiber web inside of the loop of the wires 10, 20, 30. In that way the sizing agent contacts stock layer on the suction means 15, 25, 35 areas.

Advantageously, only one application device C10, C20, C30, C40 for the foam is used, which device C10 most advantageously applies the foam onto the fiber web layer on the lower wire 10. The application device C20 for the foam can also be only applicating onto the fiber web on the wire 20 or the application device C30 for the foam can also be only applicating onto the fiber web on the wire 30. Additionally, yet another application device C40 can be used to apply the sizing agent in the form of foam on to the web layer on the lower wire after joining the web layer on the lower wire 10 and the web layer on the upper wire 20. It is also possible to use two application devices C10, C20, C30, C40 or three application devices C10, C20, C30, C40 or all four application devices C10, C20, C30, C40 as shown in the example of FIG. 2. Also, more than one application device C10, C20, C30, C40 can be used consecutively for one fiber web layer.

The stock forming the middle layer of the multi-ply fiber web guided on the wire 20 is after the one-wire substantially horizontal part, guided downwards towards the first wire 10 and the runs of the wire 10 for the bottom layer and the wire 20 for the middle layer are united by a combining roll 23 to form a twin wire part. The webs for the bottom layer and the middle layer are guided into a gap formed between the wires 10, 20 forming the twin-wire part of the forming unit. Web layers have been joined together by a combining roll 23 at the beginning of the twin-wire forming part. The combining roll 23 is situated inside the middle layer wire loop 20. Thus, the sizing agent applied in the form of foam by the curtain application devices C10, C20 onto the bottom and middle layer of the web is guided in between the layers.

Advantageously, after applying the sizing agent in the form of foam by the curtain application device C10 its conveyance and penetration into the web layer is assisted such that the sizing agent is moved deeper into the web layer on which the sizing agent is applied in the form of foam by guiding the foam deeper into the web layer. In the example of FIG. 2 a suction means 17 is provided inside the lower wire loop 10 and after the application of the sizing agent in the form of foam by the curtain application device C10 but before the web layers are joined by the combining roll 23 at the beginning of the twin-wire forming part in order to assist the conveyance and penetration of the sizing agent into the web layer.

Additionally advantageously, after applying the sizing agent in the form of foam by the curtain application device C20 and after the web layers have been joined by the combining roll 23 conveyance of the sizing agent is further enhanced by guiding the direction of conveyance of the sizing agent from the surface over the joining boundary towards the web layer on the other side of the boundary of the joining web layers. In the example of FIG. 2 a suction means 18 is provided inside the lower wire loop 10 and after the application of the sizing agent in the form of foam by the curtain application device C20 and after the web layers have been joined by the combining roll 23 at the beginning of the twin-wire forming part in order to enhance the conveyance of the sizing agent over the boundary between the web layers joined.

After the joining of the layers the multi-ply fiber web is guided on the wire 10 supporting the bottom side of the multi-ply fiber web on a substantially horizontal wire part, during which run support foils 14 are located inside the wire 10 loop. The support foils 14 do not deviate the run of the wire 10 but only remove water from the bottom surface of the wire 10 and support the run of the wire 10 as the multi-ply fiber web is guided towards the next twin wire part. The stock forming the top layer of the multi-ply fiber web guided on the wire 30 is after a substantially horizontal wire part guided downwards towards the first wire 10 and the runs of the wire 10 which now carries the bottom and middle layers and the wire 30 for the top layer are united by a combining roll 33 to form a second twin wire part and the webs for the bottom and middle layers and the top layer are guided into a gap formed between the wires 10, 30 forming the second twin-wire part of the forming unit. Thus the web layers have been joined together by a combining roll 33 at the beginning of the second twin-wire forming part. The combining roll 33 is situated inside the top layer wire loop 30. Thus, the sizing agent applied in the form of foam by the curtain application device C30 onto the top layer of the web is guided in between the top layer and the combined bottom-middle layer and the sizing agent applied in the form of foam by the curtain application device C40 is guided in between the top layer and the combined bottom-middle layer.

Advantageously, after applying the sizing agent in the form of foam by the curtain application devices C30, C40 and after the web layers have been joined by the combining roll 33 conveyance of the sizing agent is further enhanced by guiding the direction of conveyance of the sizing agent from the surface in to the web layer on the lower wire 10 and over the joining boundary towards the web layer on the other side of the boundary of the joining web layers. In the example of FIG. 2 a suction means 18 is provided inside the lower wire loop 10 and after the application of the sizing agent in the form of foam by the curtain application devices C30, C40 and after the web layers have been joined by the combining roll 33 at the beginning of the twin-wire forming part in order to enhance the conveyance of the sizing agent over the boundary between the web layers joined.

After the joining of the layers the multi-ply fiber web is guided on the wire 10 supporting the bottom side of the multi-ply fiber web on a substantially horizontal wire part, along the horizontal wire part run, support foils 16 are located inside the wire 10 loop. The support foils 16 do not deviate the run of the wire 10 only remove water from the bottom surface of the wire 10 and support the run of the wire 10 as the multi-ply fiber web is guided via the suction roll 13 towards a pick-up roll 41 for transferring the multi-ply fiber web to a first press fabric 40 of a press section. The press section also comprises a second press fabric 50 with a roll 51. The press fabrics 40, 50 comprise rolls 42, 52 for guiding, tensioning and/or driving the fabrics 40, 50 in an endless loop. In the press section the multi-ply fiber web is guided between the first press fabric 40 and the second press fabric 50 to a press nip formed between a first press roll 45 and a second press roll 55. After the press section the fiber web is guided to a drying section (not shown).

Correspondingly the application of the sizing agent in the form of foam can be provided for multi-ply fiber webs with more layers than in the examples of FIGS. 1 and 2.

Figure 3:
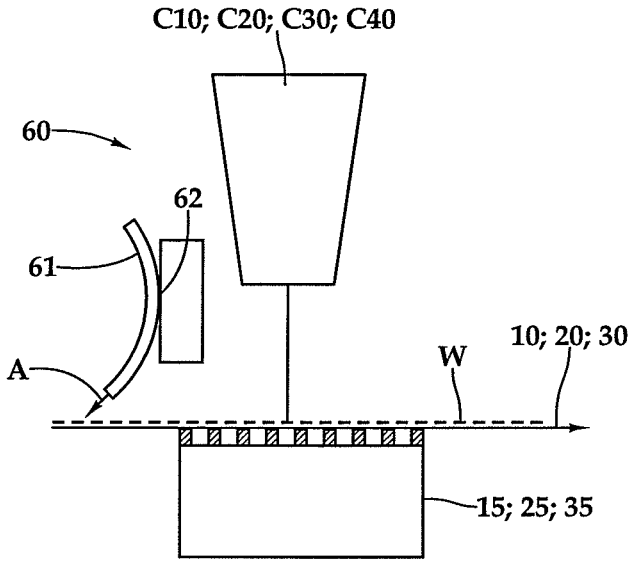
In FIG. 3 is shown schematically a curtain application device and an air guide-steam box arrangement according to an advantageous example.

In FIG. 3 is shown a curtain application device C10, C20, C30, C40 and an air guide 61, and a steam box 62 arrangement 60. The curtain application device C10, C20, C30, C40 is advantageously located such that the suction means 15, 25, 35 are located on the opposite side of the multi-ply fiber web W and the wire 10, 20, 30. In the example as the air guide a reversing blade or air foil 61 is used before the curtain application device C10, C20, C30, C40 for turning boundary air flow A off the running direction of the multi-ply fiber web W before curtain application of the sizing agent. An air curtain can also be used as the air guide. A steam-box 62 is provided just after the air guide 61.

Figure 4:
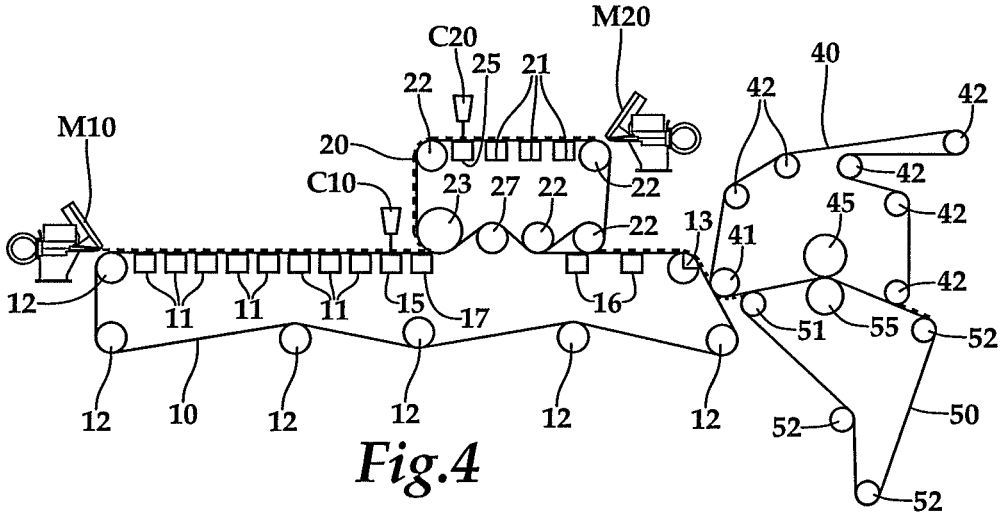
In FIG. 4 is shown schematically yet another advantageous example of a forming section according to the invention.

In FIG. 4 is shown an example of a forming section for a multi-ply fiber web, in this example for a two-layer fiber web. The forming section comprises a headbox M10, M20 for each layer, from which the stock suspension is fed to the forming unit for each layer beginning as one wire part comprising a wire 10 for the bottom layer of the multi-ply fiber web and a wire 20 for the top layer of the multi-ply fiber web, each wire comprising rolls 12, 22 for guiding, tensioning and/or driving the wire 10, 20 as an endless loop. The stock suspension M10, M20 is first fed onto the wire 10, 20 and thereafter the stock on the wire is guided past water removal means 11, 21, 15, 25 inside the loop of the wire 10, 20. Inside of the loop of the wire 10, 20 at least one suction means 15, 25 is located. During the run of the stock on a portion of the wire which is substantially horizontal, water is removed. A curtain application device C10, C20 is located over the stock layer, on the portion of the wire which is substantially horizontal for applying sizing agent in the form of foam by a curtain type application device onto the stock layer on the wire so that the sizing agent ends up between the layers of the multi-ply fiber web. The curtain application device C10, C20 is advantageously located such that the suction means 15, 25 are located on the opposite side of the multi-ply fiber web inside of the loop of the wires 10, 20. In that way the sizing agent contacts stock layer on the suction means 15, 25 area.

Advantageously, only one application device C10, C20 for the foam is used, which device C10 is most advantageously applicating the foam onto the fiber web layer on the lower wire 10. The application device C20 for the foam can also be a curtain coater which applies sizing agent onto the fiber web on the upper wire 20. It is also possible to use two application devices C10, C20 as shown in the example of FIG. 4. Also, more than one application device C10, C20 can be used consecutively for one of the fiber web layers.

The stock forming the top layer of the multi-ply fiber web guided on the wire 20 is after the substantially horizontal wire part guided downwards towards the first wire 10 and the runs of the wire 10 for the bottom layer and the wire 20 for the top layer are united by a combining roll 23 to form a twin wire part and the webs for the bottom layer and the top layer are guided into a gap formed between the wires 10, 20 forming the twin-wire part of the forming unit. Web layers have been joined together by a combining roll 23 at the beginning of the twin-wire forming part. The combining roll 23 is situated in the top layer wire loop 20. Thus, the sizing agent applied in the form of foam by the curtain application devices C10, C20 onto each layer of the web, is guided in between the layers.

Advantageously, after applying the sizing agent in the form of foam by the curtain application device C10 its conveyance and penetration into the web layer is assisted such that the sizing agent is moved deeper into the web layer on which the sizing agent is applied in the form of foam by guiding the foam to move into the web layer. In the example of FIG. 4 a suction means 17 is provided after the application of the sizing agent in the form of foam by the curtain application device C10 but before the web layers are joined by the combining roll 23 at the beginning of the twin-wire forming part in order to assist the conveyance and penetration of the sizing agent into the web layer.

Additionally advantageously, after applying the sizing agent in the form of foam by the curtain application device C10 and after the web layers have been joined by the combining roll 23 conveyance of the sizing agent is further enhanced by guiding the direction of conveyance of the sizing agent from the surface over the joining boundary towards the web layer on the other side of the boundary of the joining web layers. In the example of FIG. 4 a sleeve roll 27 is provided inside the lower wire loop 10 after the application of the sizing agent in the form of foam by the curtain application device C10 and after the web layers have been joined by the combining roll 23 at the beginning of the twin-wire forming part in order to enhance the conveyance of the sizing agent over the boundary between the web layers joined and deeper towards the top surface of the multi-ply fiber web. Alternatively, this can be provided by locating a suction means (not shown) inside the upper wire loop and thus causing the conveyance of the sizing agent towards the top surface of the multi-ply fiber web. A sleeve roll 27 is a roll that comprises a stationary support shaft, a belt loop, which is led to circle around the stationary support shaft, that the sleeve roll further comprises at least one curvilinear dewatering zone consisting of two partial curves such that the radius of curvature of a first partial curve is greater than the radius of curvature of a second partial curve following the first partial curve in the travel direction of the belt loop. A sleeve roll configuration is disclosed for example in EP patent application 2017164069 published as EP3382094.

After the joining of the layers the multi-ply fiber web is guided on the wire 10 supporting the bottom side of the multi-ply fiber web substantially horizontal wire part during which run support foils 16 are located inside the wire 10 loop. The support foils 16 do not deviate the run of the wire 10 only remove water from the bottom surface of the wire 10 and support the run of the wire 10 as the multi-ply fiber web is guided via suction roll 13 towards a pick-up roll 41 for transferring the multi-ply fiber web to a first press fabric 40 of a press section. The press section also comprises a second press fabric 50 with a roll 51. The press fabrics 40, 50 comprise rolls 42, 52 for guiding, tensioning and/or driving the fabrics 40, 50 in an endless loop. In the press section the multi-ply fiber web is guided between the first press fabric 40 and the second press fabric 50 to a press nip formed between a first press roll 45 and a second press roll 55. After the press section the fiber web is guided to a drying section (not shown).

Above only some advantageous examples of the inventions have been described to which examples the invention is not to be narrowly limited and many modifications and alterations are possible within the invention.

It should be understood that, water is removed via removal means, refers to a device or devices used in a paper machine for removing water from a fiber web these devices include mechanical dewatering devices such as forming shoes or foil strips where the movement of the wire over the shoe results in removal of water which may in part be or principally be by production of a vacuum through created hydrodynamic forces. Water is removed via removal means also includes a suction device where is used a machine to create a vacuum and connect the vacuum source to connect to a box, a roll with openings, shoe, sleeve roll, or other structure which then uses the difference in air pressure created by the vacuum source, not usually local to the device, to draw water from the web. Such use of vacuum is often referred to as a suction device such as suction boxes, turning rolls, suction rolls, and rolls provided with an open surface, which are used in many different arrangements and arrays when trying to optimize the volume, time and location of water being removed when forming the web. Vacuum in a suction roll or pick-up roll can also be used to transfer or direct a fiber web in a wire or fabric.

We claim:

1. A method for forming a multi-ply fiber paper or board web, comprising the steps of:

forming a first fiber layer of the paper or board web on a first wire in a fiber web former so the first fiber layer has a first side in contact with the first wire, and a second side opposite the first side;

forming a second fiber layer of the paper or board web on a second wire in the fiber web former so the second fiber layer has a first side in contact with the second wire, and a second side opposite the first side;

applying a sizing agent, at least part of which forms a foam, by at least one curtain application device to at least one of the second side of the first fiber layer and the second side of the second fiber layer;

forming a multi-ply fiber web in a twin-wire forming part of the former by bringing the second side of the first fiber layer on the first wire into engagement with the second side of the second fiber layer on the second wire so that the sizing agent is between the first fiber layer and the second fiber layer and the first wire and the second wire form the twin-wire forming part of the former; and conveying in the twin-wire forming part of the former the sizing agent from one of the first fiber layer of the paper or board web and the second fiber layer of the paper or board web over a boundary therebetween into the other of the first fiber layer of the paper or board web and the second fiber layer of the paper or board web so that the sizing agent enhances ply-bond strength.

2. The method of claim 1 wherein the step of applying the sizing agent by at least one curtain application device is done such that the at least one curtain application device does not contact the first fiber layer and does not contact the second fiber layer.

3. The method of claim 2 wherein the step of applying the sizing agent comprises passing the sizing agent through a slot in the at least one curtain application device.

4. The method of claim 1 wherein at least one device for removing water is positioned below at least one of the first wire and the first side of the first fiber layer and the second wire and the first side of the second fiber layer at a location below the at least one curtain application device.

5. The method of claim 1 wherein conveyance and penetration of the sizing agent into the multi-ply fiber web over a boundary formed between the first fiber layer and the second fiber layer is guided by a suction device at a beginning of the twin-wire forming part.

6. The method of claim 1 further comprising the step of using an air guide to turn a boundary air flow off a running direction of at least one of the first fiber layer second side and the second fiber layer before the step of applying a sizing agent by said at least one curtain application device.

7. The method of claim 1 wherein conveyance and penetration of the sizing agent into the multi-ply fiber web over the boundary formed between the first fiber layer and the second fiber layer is by a combining roll at the beginning of the twin-wire forming part positioned inside the second wire which forms an upper wire loop, the combining roll being positioned after the application of the sizing agent in the form of foam by the curtain application device.

8. The forming section of claim 7 wherein conveyance and penetration of the sizing agent into the multi-ply fiber web over the boundary formed between the first fiber layer and the second fiber layer is guided by a sleeve roll positioned inside the first wire which forms a lower wire loop.

* * * * *